US010897955B2

(12) United States Patent
Liu et al.

(10) Patent No.: US 10,897,955 B2
(45) Date of Patent: Jan. 26, 2021

(54) CONDUCTIVE SOLES FOR PROTECTIVE SUITS

(71) Applicant: Ansell Limited, Richmond (AU)

(72) Inventors: Jing Liu, Fenghuang Town (CN); Zhimin Zhu, Hangzhou (CN); Paul Bryce, Beverley (GB)

(73) Assignee: Ansell Limited, Victoria (AU)

( * ) Notice: Subject to any disclaimer, the term of this patent is extended or adjusted under 35 U.S.C. 154(b) by 57 days.

(21) Appl. No.: 16/326,047

(22) PCT Filed: Aug. 29, 2017

(86) PCT No.: PCT/AU2017/000176

§ 371 (c)(1),
(2) Date: Feb. 15, 2019

(87) PCT Pub. No.: WO2018/039699

PCT Pub. Date: Mar. 8, 2018

(65) Prior Publication Data

US 2019/0183210 A1 Jun. 20, 2019

Related U.S. Application Data

(60) Provisional application No. 62/381,167, filed on Aug. 30, 2016.

(51) Int. Cl.

| | |
|---|---|
| ***A43B 7/36*** | (2006.01) |
| ***A43B 13/04*** | (2006.01) |
| ***A41D 13/008*** | (2006.01) |

(52) U.S. Cl.

CPC ..... *A43B 7/36* (2013.01); *A41D 13/008* (2013.01); *A43B 13/04* (2013.01); *A41D 2600/20* (2013.01)

(58) Field of Classification Search

CPC ..... A43B 7/36; A43B 13/02; A43B 13/026; A43B 13/04; A43B 13/28; A43B 13/32;
(Continued)

(56) References Cited

U.S. PATENT DOCUMENTS 2,279,094 A * 4/1942 Siers ..... A43B 7/36 361/224
2,710,366 A * 6/1955 Stern, Jr. ..... A43B 7/36 361/224

(Continued)

FOREIGN PATENT DOCUMENTS

DE 202008-002745 U1 5/2008
EP 1203539 A1 5/2002

(Continued)

OTHER PUBLICATIONS

International Search Report for PCT Application No. PCT/AU2017/000176 dated Nov. 29, 2017.

*Primary Examiner* — Amy Vanatta
(74) *Attorney, Agent, or Firm* — Moser Taboada

(57) ABSTRACT

A shoe (200) that includes a first piece of fabric (202) having an inner perimeter (207) and an outer perimeter (205) and a first piece of conductive material, joined with the inner perimeter of the first piece of fabric, wherein an inner perimeter of the first piece of fabric surrounds the first piece of conductive material to form a conductive sole (214) and the outer perimeter of the first piece of fabric is adapted to be joined to another fabric.

20 Claims, 4 Drawing Sheets

(58) Field of Classification Search
CPC ..... A43B 3/163; A41D 13/008; A41D 13/02; A41D 2600/20; A43D 2200/10
USPC ..... 12/146 B, 146 BR, 142 T, 142 R, 17 R, 12/31.5
See application file for complete search history.

(56) References Cited

U.S. PATENT DOCUMENTS 3,007,083 A * 10/1961 MacQuaid, Jr. ..... A43B 13/38 361/224
3,293,494 A 12/1966 Fischer
3,431,570 A * 3/1969 Murphy ..... A43B 3/14 12/142 D
4,150,418 A * 4/1979 Berbeco ..... A43B 7/36 361/224
4,847,914 A * 7/1989 Suda ..... A62B 17/006 2/457
5,653,047 A * 8/1997 Franey ..... A43B 7/36 36/136
5,715,536 A * 2/1998 Banks ..... A43B 7/36 2/69
6,026,512 A 2/2000 Banks
7,900,272 B1 * 3/2011 Tan ..... A41D 13/008 2/69
2004/0071916 A1 4/2004 Romanowski
2007/0000155 A1 * 1/2007 Laufer ..... A43B 7/36 36/136
2010/0083429 A1 4/2010 Carraro
2013/0047471 A1 * 2/2013 Liang ..... A43B 7/1405 36/136
2016/0286893 A1 * 10/2016 Huebsch ..... A43B 7/36

FOREIGN PATENT DOCUMENTS

EP 1419708 A1 * 5/2004 ..... A43B 3/005
GB 1463998 2/1977
WO WO-9220249 A1 * 11/1992 ..... A43B 7/36
WO WO 98-25492 A1 6/1998
WO WO 2015-071494 A1 5/2015

* cited by examiner

CONDUCTIVE SOLES FOR PROTECTIVE SUITS

BACKGROUND

Field

Embodiments of the disclosure relate to conductive soles for garments, e.g. to shoes. Further, embodiments of the disclosure generally relate to protective garments and, more particularly, to conductive soles for use in conjunction with protective suits to ground users. The conductive soles may protect from electrostatic discharges in tribocharging, static electricity and/or electrostatic induction environments.

Description of the Related Art

Protective suits, such as HAZMAT suits, splash suits, tactical suits for law enforcement, gas tight suits, and other encapsulating suits are used in many industrial environments to protect users against chemical and/or gaseous hazards. Many hazards are flammable, hydro-carbon chemicals. Accordingly, it is important to eliminate or attenuate the risk of electrostatic discharge, which can ignite hydro-carbons. Also, workers wear protective suits during electronics manufacturing, such as the manufacture of integrated circuits or any equipment containing integrated circuits. Grounding is necessary to prevent damage to electronics from static electricity and/or electrostatic discharge (ESD).

Sparks, which are a form of electrostatic discharge, are often created by the tribocharging of shoes while walking. At least one manner by which electrostatic discharge and/or sparks can be avoided is via grounding. However, protective suits typically consist of multi-layer suits having a non-absorptive outer layer and one or more inner layers of a barrier laminate, which comprise elastomers, thermoplastic films and fabrics. The sole of such suits are typically made of the same material as the suit.

Soles that may comprise materials that are conductive and/or capable of being joined with a protective suit, providing a barrier from chemicals and gases, would represent an advance in the art.

SUMMARY

Embodiments disclosed herein comprise a conductive sole substantially as shown in and/or described in connection with at least one of the figures. The conductive sole is optionally joined to a fabric to form a shoe. Various advantages, aspects and novel features of the present disclosure, as well as details of an illustrated embodiment(s) thereof, will be more fully understood from the following description and drawings.

BRIEF DESCRIPTION OF THE DRAWINGS

So that the manner in which the above recited features disclosed herein can be understood in detail, a more particular description of the embodiments, briefly summarized above, may be had by reference to the appended drawings. It is to be noted, however, that the appended drawings illustrate only typical embodiments and are therefore not to be considered limiting of its scope, for the embodiments may admit to other equally effective embodiments.

While several embodiments and illustrative drawings are disclosed herein, those skilled in the art will recognize that the disclosure is not limited to the embodiments of drawing or drawings described. It should be understood that the each of the drawings and detailed description thereto are not intended to limit the embodiments to the particular form disclosed, but on the contrary, the disclosure covers all modifications, equivalents and alternatives falling within the spirit and scope of the present embodiments as defined by the appended claims. For example, illustrated features for one embodiment can be used in conjunction with other embodiments to yield further embodiments. Also, the headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include," "including," and "includes" mean including, but not limited to.

DETAILED DESCRIPTION

Figure 1:
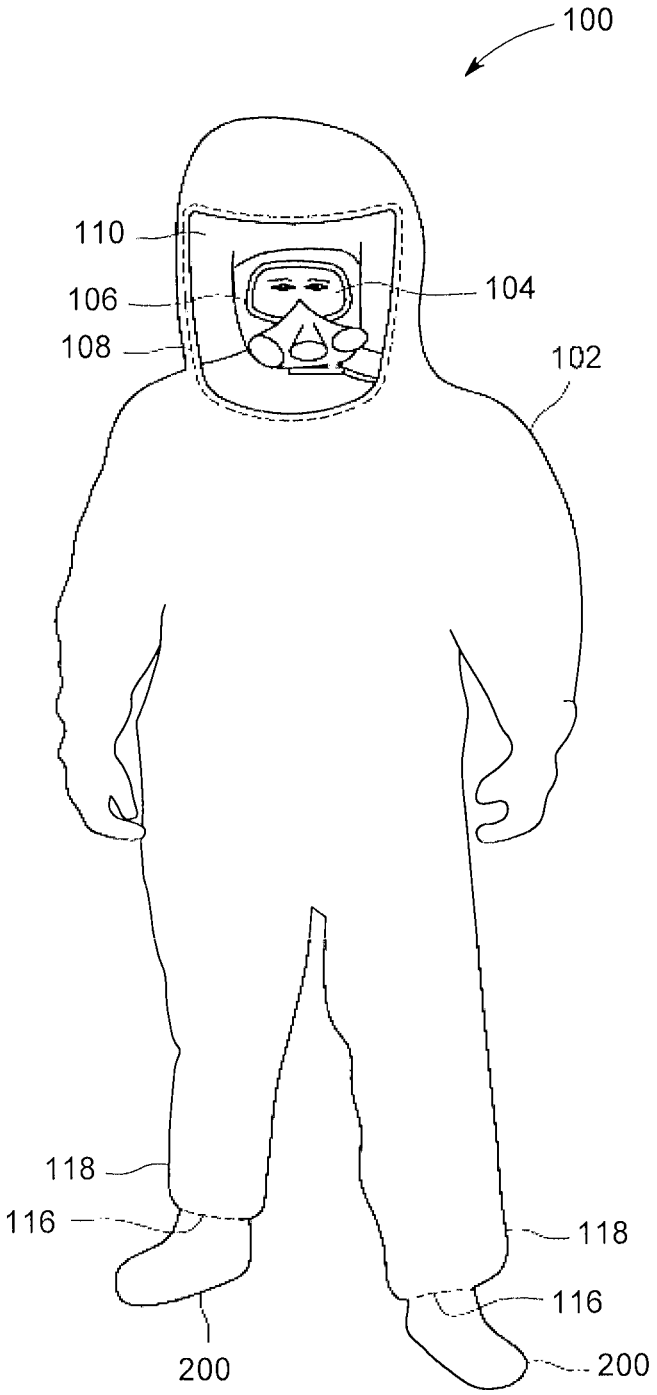
FIG. 1 shows personal protective equipment, comprising an exemplary protective suit, according to embodiments of the disclosure.

FIG. 1 shows personal protective equipment 100, comprising an exemplary protective suit 102, according to embodiments of the disclosure. The protective suit 102 comprises one or more shoes 200, as described more fully below. The one or more shoes 200 are attached to the protective suit 102 in one or more shoe attachment regions. Some embodiments include a shoe attachment region such as attachment region 116, which is adjacent a leg cuff 118. The protective suit 102 comprises materials, such as laminated fabrics. The laminated fabrics can have barrier properties and/or the like. Protective suits, coveralls, laminated fabrics, and technologies disclosed in commonly assigned U.S. Pat. Nos. 7,921,467; 8,247,077; 8,268,451; and 8,505,112, are incorporated by reference herein can be used in conjunction with embodiments discussed herein. Any of the embodiments of the disclosure herein can comprise a protective suit that is an encapsulated suit or a non-encapsulated suit, e.g., coveralls.

A shoe 200 comprises a conductive sole (shown below) that can comprise at least one of various materials, such as a polyolefin, a polyolefin elastomer, a thermoplastic vulcanizate, a thermoplastic elastomer composition or any combination thereof. The polyolefin, the thermoplastic vulcanizate, the thermoplastic elastomer composition(s) are doped with or otherwise contain a conductive additive(s) that is, for example, compounded therein. According to the disclosure, the shoe or a conductive sole can include a material containing conductive additives. For example, the conductive sole may include a thermoplastic material containing conductive carbon black particles. An exemplary conductive additive is a conductive carbon black. Conductive rubber composition having a conductive additive(s) is disclosed in Table 1, wherein the ranges of amounts of components are provided in weight by weight (w/w) percentages. Table 2 includes another exemplary conductive rubber composition. The ranges of components embodied within the conductive rubber compositions of Tables 1-2 further comprise wherein the ranges of components are adjusted as appropriate for a given physical property. A conductive sole can be made of either of the rubber compositions of Tables 1-2, including variations thereof that may comprise a blend of any of the thermoplastic materials, thermoplastic vulcanizates, thermoplastic polyolefins, and/or the like.

The shoe 200 according to the disclosure can comprise a conductive sole having approximately $10^4$ to approximately $10^8$ ohms of volume resistance wherein the shoe 200 is capable of preventing tribocharging and/or electrostatic discharge. The shoe 200 can be capable of substantially preventing tribocharging, attenuating the risk of electrostatic discharge. Exemplary embodiments can comprise a conductive sole having a volume resistance of less than $10^5$ ohms. The thickness of the conductive soles, as described more fully below, of the shoes 200 generally ranges from approximately 0.70 mm to 1.0 mm. The thickness of the conductive soles including the cross-sectional thickness measured across the conductive soles and a seal of the shoes 200 generally ranges from approximately 0.90 mm to 1.1 mm. The shoes 200 may be any suitable thickness, i.e., thinner or thicker than 0.90 to 1.1 mm.

TABLE 1

| Conductive Rubber Composition | |
|---|---|
| Component | Amount (w/w) |
| Polyolefin elastomer | ≥42 |
| Mineral oil | 15-20 |
| Conductive carbon black | 10-15 |
| Filler | 15-20 |
| Additives | 0.5-3 |

TABLE 2

| Conductive Rubber Composition | |
|---|---|
| Component | Amount (w/w) |
| Polyolefin elastomer | 42-70 |
| Mineral oil | 10-20 |
| Conductive carbon black | 5-15 |
| Filler | 15-20 |
| Additives | 0-3 |

As described above, the conductive sole may comprise a polyolefin, a polyolefin elastomer, a natural rubber, a synthetic polyisoprene, a butyl rubber, a nitrile-butadiene rubber, a polyurethane, or a poly(vinyl chloride) composition and/or blends thereof. At least one exemplary polyolefin is a thermoplastic polyolefin. Exemplary embodiments may include wherein the polyolefin is an ethylene-propylene-diene monomer material (EPDM), which can be blended with any other of a natural rubber, a synthetic polyisoprene, a butyl rubber, a nitrile-butadiene rubber, a polyurethane, or a poly(vinyl chloride) composition. Any embodiment according to the disclosure of the conductive rubber compositions can comprise polyester materials within the formulations of Tables 1 and 2. In any of the embodiments, the composition(s) may further comprise 5-30% (w/w) one or more plasticizers. In any of the embodiments, the composition(s) may further comprise 1-10% (w/w) of a curing agent(s), such as sulfur and/or sulfur-containing vulcanizing agents, and/or the like. In any of the embodiments, the composition(s) may comprise disulphidic donors and/or polysulphidic donors, such as various xanthogens or tetrasulphide thiurams as known to those in the art. In any of the embodiments, the composition(s) may comprise activators, such as zinc oxides. Conventional fillers, processing agents, and plasticizers can be used in embodiments of the conductive rubber compositions. Examples of fillers in the composition(s) include non-conductive carbon black materials, calcium carbonate, clays, aluminosilicates, and/or other fillers as are known to those of skill in the art.

A shoe 200 is capable of being sealed to the protective suit 102 using any one or more of different processes. For example, these processes include the use of heat sealing tapes, hot bar heat sealing, or high frequency welding. One suitable high frequency welding process is ultrasonic welding. Exemplary embodiments according to the disclosure include joining the shoes 200 to the protective suit 102 via heat sealing tapes followed by heating, for e.g., heating by ultrasonic welding. The shoes 200 are, for example, made of materials that are calendared and die cut, as described more fully below. The melting point of the conductive soles of the shoes 200 may be generally lower than the melting point of the material of which the protective suit 102 is comprised. For example, conductive soles having a base resin comprising, for example, one or more thermoplastic elastomers, thermoplastic polyolefins, thermoplastic rubbers and/or the like, are generally suitable for hot bar sealing processes.

The protective suit 102, optionally further comprises a visor 110. The protective suit 102 can be worn, for example, by a person 104, wearing a face mask 106 in the close proximity to the face of the person 104. The visor 110 is attached to the protective suit 102 at a visor attachment area 108. The visor attachment area can be along the periphery of the visor 110. The visor attachment area 108 provides for attaching visor 110 to the protective suit 102. The visor 110 may be attached to the suit 102 by various attachment means, such as those known to one of ordinary skill in the art, including but not limited to, for example, adhesives, glues, epoxies, heat-sealing tapes, thermal seals, such as heat staking and high-frequency welding, and the like. In any or all embodiments, the attachment means include hook and loop fasteners, e.g., VELCRO®, stitching, and/or other attachment means generally known in the art. The protective suit may further comprise a face mask 106.

According to embodiments of the disclosure, a shoe is provided. The shoe includes a first piece of fabric, e.g. fabric 202, in a shape having an inner perimeter and an outer perimeter; and an oval shaped piece of conductive material, such as a conductive insert 201, joined with the inner perimeter of the first piece of fabric, wherein an inner perimeter of the first piece of fabric surrounds the conductive material to form a conductive sole and the outer perimeter is adapted to be joined to another fabric.

Figure 2:
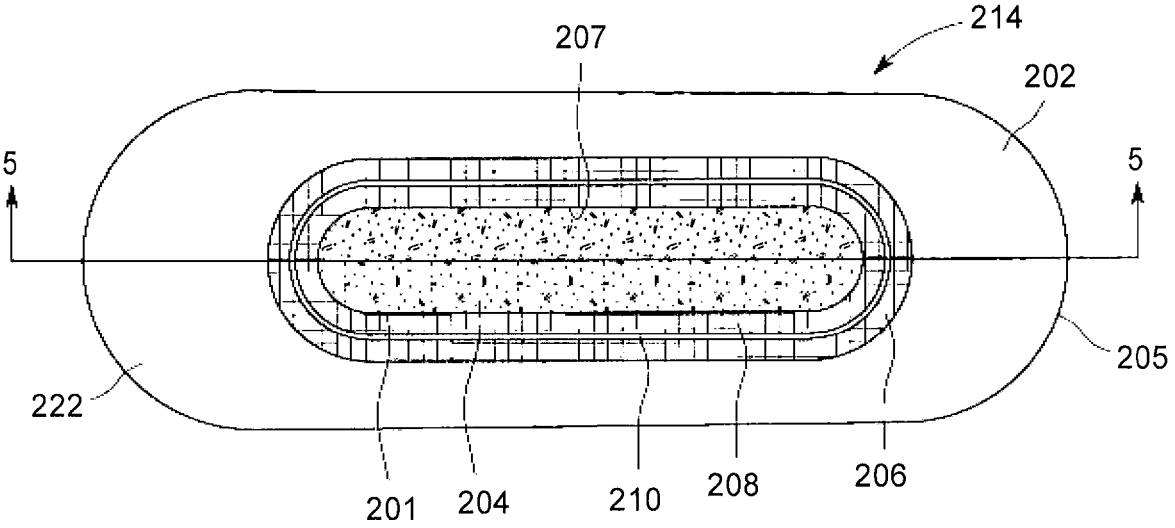
FIG. 2 shows an external plan view of a conductive sole, according to embodiments of the disclosure.

FIG. 2 shows an external plan view of a conductive sole 214, according to embodiments of the disclosure. The conductive sole 214 comprises a fabric 202 having an outer surface 222. The fabric 202 comprises an inner perimeter 207 and an outer perimeter 205. The fabric 202 can be a non-woven, woven, or knit fabric. In exemplary embodiments, the fabric 202 comprises any of the materials in Table 3. As shown, the fabric 202 is a toroid, i.e., oval in shape and comprising a general oval shape cutout from an interior portion of the fabric 202. The fabric 202 can comprise other shapes, e.g., rectangular, circular, triangular, etc., having a cutout therein. The fabric 202 is optionally coated or laminated and/or calendared with fabrics and/or polymeric layers/laminates. The conductive sole 214 comprises a conductive insert 201 having an outer conductive surface 204. The conductive insert 201 can comprise a thermoplastic elastomer, thermoplastic polyolefin, and/or thermoplastic rubber. The conductive insert 201 can be made of either of the rubber compositions of Tables 1-2, including variations thereof that may comprise a blend of any of the thermoplastic materials, thermoplastic vulcanizates, thermoplastic polyolefins, and/or the like that are discussed herein.

The conductive insert 201 can comprise conductive additives. The conductive insert 201 can comprise any suitable shape for joining with the fabric 202, e.g., rectangular, circular, triangular, etc. A suitable conductive additive, which can be used solely or be combined with other conductive additives is conductive carbon black, as discussed with respect to the conductive rubber compositions of Tables 1 and 2. The outer surface 222 contacts a floor or ground when worn as a shoe or part of a suit. The outer conductive surface 204, or at least a part thereof, contacts a floor or ground. The conductive sole 214 may optionally be joined to another fabric. Accordingly, the conductive sole 214 is adapted to be a component of a conductive shoe, for example, the shoe 200.

The conductive sole 214, as exemplarily shown in FIG. 2, further comprises a first sole attachment area 206, a second sole attachment area 208, a middle sealed area 210, e.g. a middle sealed, unbonded area 210, disposed between the first sole attachment area 206 and the second sole attachment area 208, collectively, a double bar seal discussed more fully below. The first sole attachment area 206 can be approximately 5-7 mm wide. Additionally or alternatively, the second sole attachment area 208 can be approximately 5-7 mm wide. Additionally or alternatively, the middle sealed, unbonded area 210 can be approximately 3-5 mm wide. The conductive sole 214 can approximately 300-400 mm in length across a major axis and/or approximately 125-150 mm wide across a minor axis. The thickness of the conductive sole 214 of the shoes 200 generally ranges from approximately 0.70 mm to 1.0 mm. The thickness of the conductive sole 214 including the cross-sectional thickness measured across the conductive sole 214 and a seal of the shoes 200 generally ranges from approximately 0.90 mm to 1.1 mm. The shoes 200 may be any suitable thickness, i.e., thinner or thicker than 0.90 to 1.1 mm. It is to be understood that the conductive sole 214 may be joined to a suit, effectively making the conductive sole 214 capable of preventing tribocharging without the addition of any other fabric prior to joining with a suit.

Figure 3:
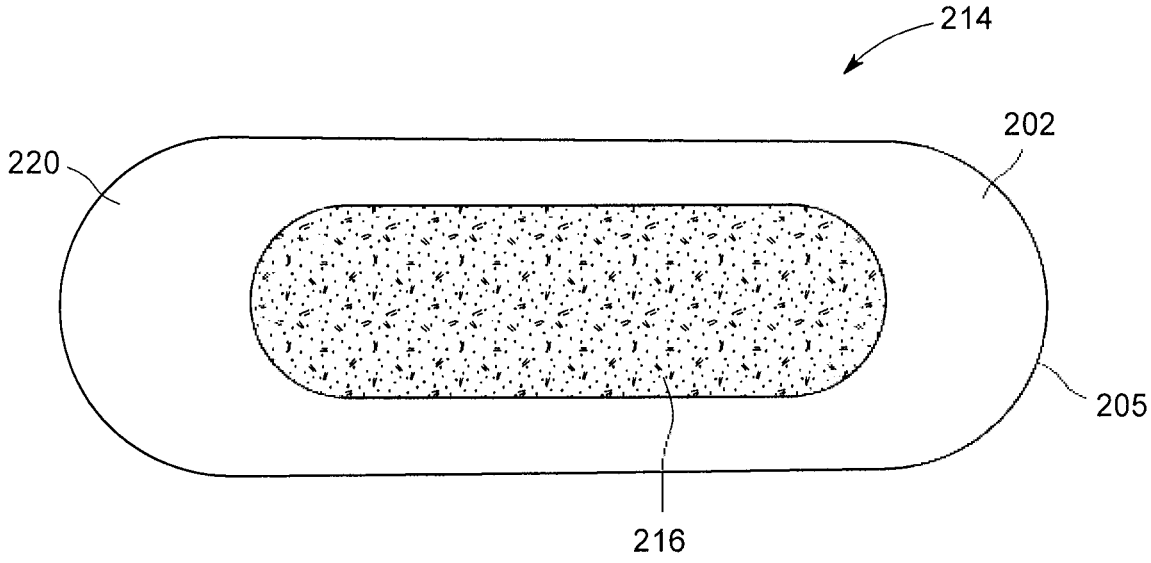
FIG. 3 shows an internal plan view of the conductive sole, according to embodiments of the disclosure.

FIG. 3 shows an internal plan view of the conductive sole 214, according to embodiments of the disclosure. The conductive sole 214 has an internal surface 220, comprising the fabric described above, wherein the fabric is attached to the conductive sole 214 via, for example, hot bar sealing. The conductive sole 214 comprises an inner conductive surface 216 opposite the outer conductive surface 204 (not shown), described above, which a foot would contact when the conductive shoe is worn. The conductive sole 214 may be molded in a specific shape or die cut to a specific shape from a sheet of material (not shown) comprising a thermoplastic material and conductive particles.

Table 3 depicts a non-exhaustive list of multi-layer materials/laminates, e.g., M2500, M3000, M4000, and M5000, marketed by Ansell Microgard, Ltd., that can be used to make protective suits, as discussed herein. These materials are described more fully in US Publ. No. 20140141210, are commonly assigned with the present disclosure, and are fully incorporated herein in entirety. These multi-layer materials comprise various combinations of copolymer polypropylene layers, non-woven, spun-bonded polypropylene layers, polyamide layers, and ethylene vinyl alcohol layers. Many different multi-layer materials ort laminates may be used as fabrics discussed herein, for example, without limitation fabric 202. M3000 comprises a copolymer polypropylene/polyethylene (PP/PE) outer film with a spunbond inner layer and meltblown PP sandwich layer. M4000 comprises a copolymer PP/PE outer film with a spunbond inner layer and a coextruded PP/EVOH/PP high barrier film. M5000 comprises a copolymer PP/PE outer film with a spunbond inner layer and a coextruded PP/PA/PP high barrier film, wherein PA is a polyamide material layer. M2500 is a microporous PP film thermal laminated to a spunbond PP nonwoven substrate.

Other materials comprise, for example, two copolymer polypropylene layers having an ethylene vinyl acetate or ethylene vinyl alcohol (EVA/EVOH) layer disposed therebetween, wherein an adhesive tie layer adheres the (EVA/EVOH) with each of the two copolymer polypropylene layers. Another material may comprise a copolymer propylene layer, a nonwoven spunbond polypropylene layer, and the M3000 fabric disposed therebetween. Another material may comprise, for example, comprises a copolymer propylene layer, a spunbond polypropylene layer, and a middle layer disposed therebetween. In some embodiments, the middle layer comprises a polypropylene-polyamide-polypropylene laminate. Table 3 further lists approximate temperatures, pressures, and time durations for joining the multi-layer materials to the conductive soles, wherein the temperatures are described in degrees Celsius (° C.), the pressures in mega-Pascals (MPa), and the times in seconds (s).

TABLE 3

| Multi-layer | Sole | Temp. (° C. ) | Pressure (MPa) | Time (s) |
|---|---|---|---|---|
| M2500 | TPR | ~165 | 0.5-0.8 | 6~8 |
| M3000 | TPR | ~170 | 0.5-0.8 | 6~8 |
| M4000 | TPR | ~175 | 0.5-0.8 | 6~8 |
| M5000 | TPR | ~180 | 0.5-0.8 | 6~8 |

Figure 4:
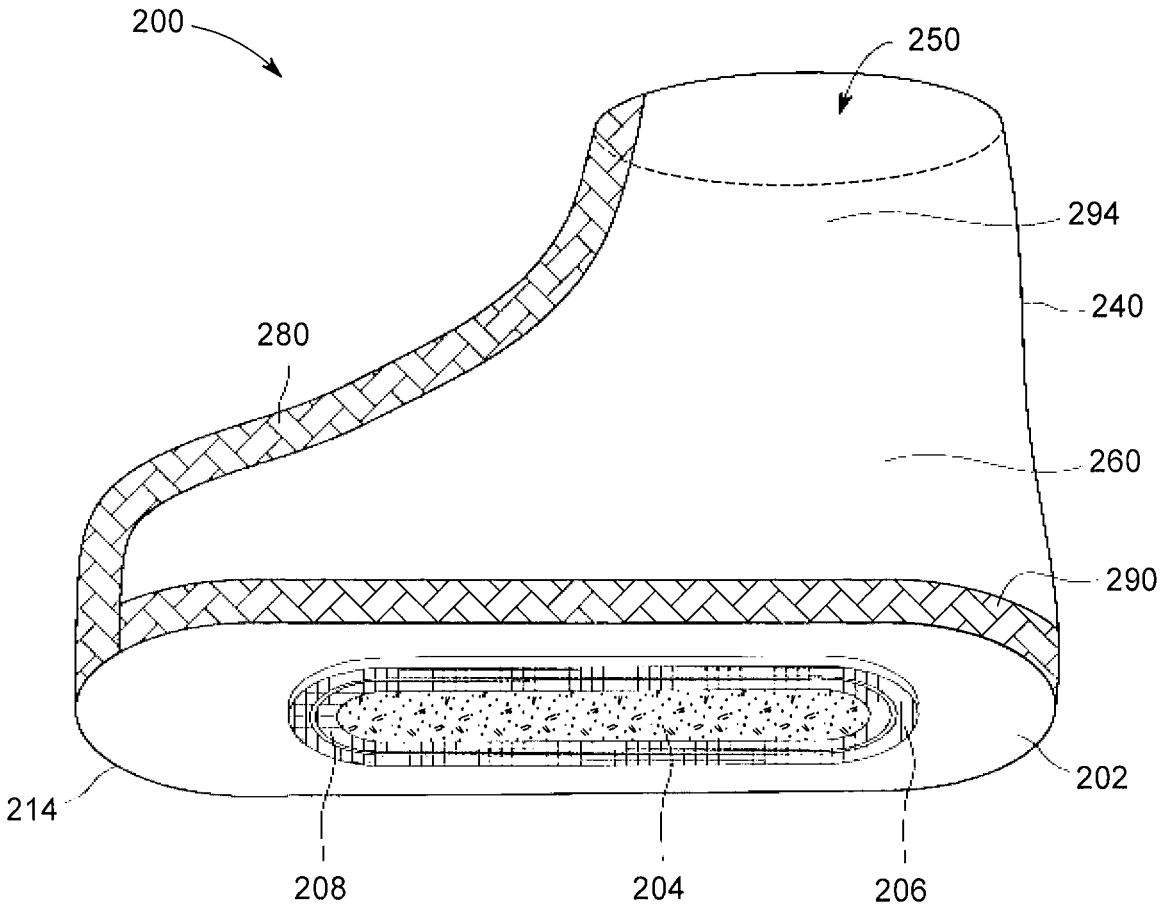
FIG. 4 shows a shoe having a conductive sole, according to embodiments of the disclosure.

FIG. 4 shows a shoe 200 having a conductive sole 214, according to embodiments of the disclosure. The shoe 200, as exemplarily shown in FIG. 4, comprises the conductive sole 214 attached to a foot member 240 having an opening 250 for receiving a foot of a wearer. The foot member 240 comprises a fabric, such as fabric 202. The fabric may be a similar non-woven, woven, or knit fabric, as described above or, optionally, may comprise a different fabric. The foot member 240 may be constructed of one or more pieces of fabric in the shape of a shoe or boot. The foot member 240 may also be generally cylindrical. As exemplarily shown in FIG. 4, the foot member 240 can comprise one piece of fabric 260 that is joined unto itself at instep seam 280. The fabric 260 can be approximately 300-400 mm in length across a major axis and approximately 125-150 mm wide across a minor axis. According to embodiments of the disclosure, the conductive sole 214 can be joined to foot member 240 at sole seam 290. The instep seam 280 may be joined to the sole seam 290, for example, using heat-sealing tapes. The foot member 240 may be joined to a protective suit 102. For example, a leg seam 294 may be joined to the leg cuff 118 using ultrasonic welding and/or heat sealing processes around the perimeter of the leg seam 294.

Figure 5:
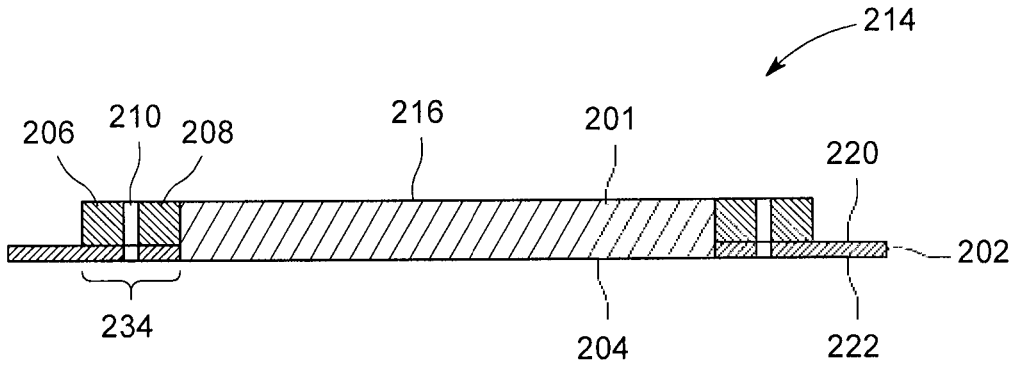
FIG. 5 shows a cross section of the conductive sole of FIG. 2, according to embodiments of the disclosure.

FIG. 5 shows a cross section of the conductive sole 214 of FIG. 2, according to embodiments of the disclosure. The conductive sole 214 comprises the fabric 202 and the conductive insert 201. The fabric 202 comprises an outer surface 222 and an internal surface 220. The fabric 202 comprises a non-woven, woven, or knit fabric. The fabric 202 is optionally coated or laminated/calendared with additional fabrics and/or polymeric layers. The conductive sole 214 comprises a first sole attachment area 206, a second sole attachment area 208, a middle sealed area 210 disposed between the first sole attachment area 206 and the second sole attachment area 208, collectively, a double bar seal 234. The conductive sole 214 comprises the outer conductive surface 204.

Figure 6:
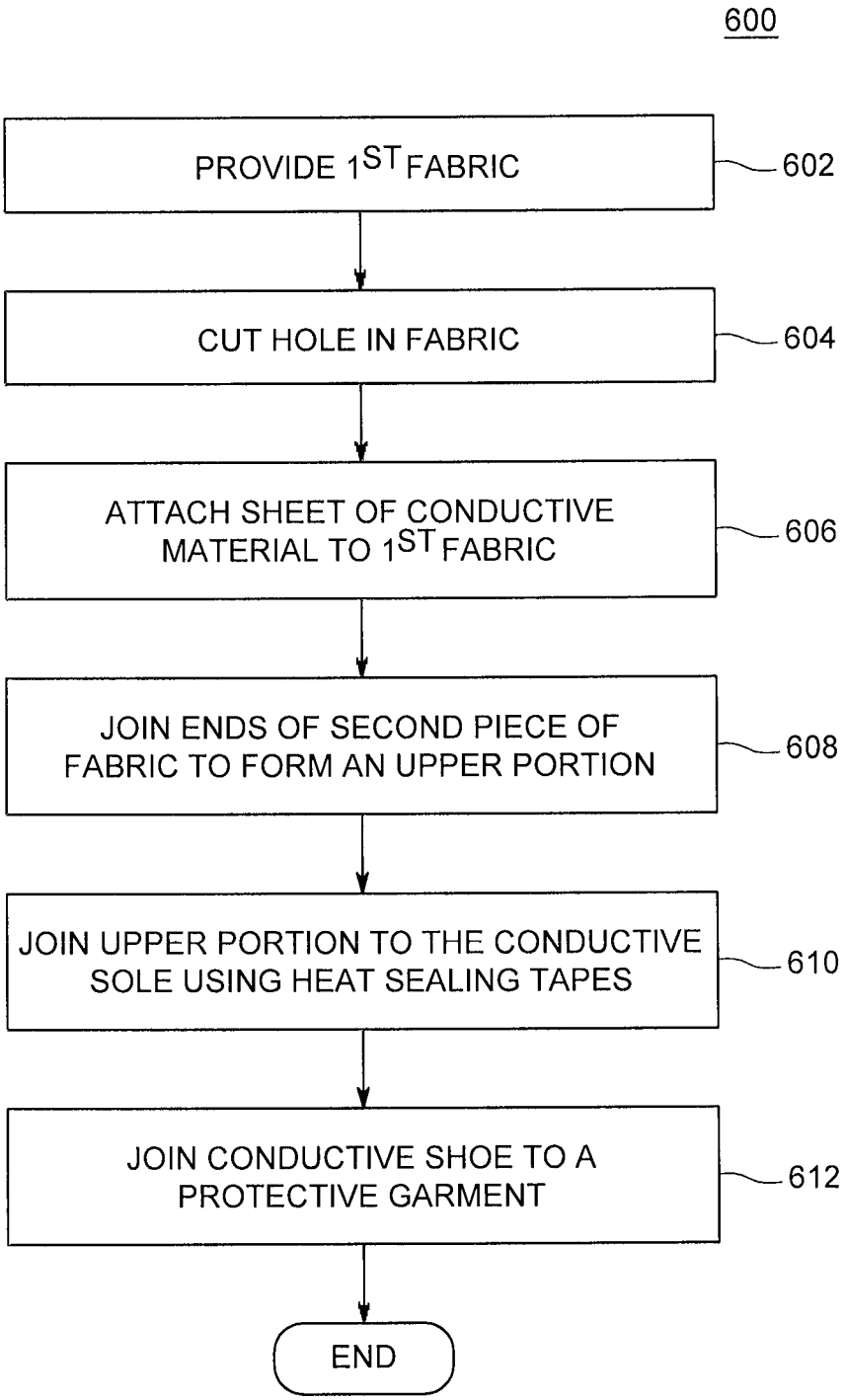
FIG. 6 shows a flow diagram for a method of making a conductive sole and joining the conductive sole with a protective suit, according to embodiments of the disclosure.

FIG. 6 shows a flow diagram 600 for a method of making a conductive sole and joining the conductive sole with a protective suit, according to embodiments of the disclosure. The method 600 starts at step 602, wherein a piece of fabric is provided. At step 604, the piece of fabric is cut, creating a generally toroid shape. Alternatively, the piece of fabric can be cut in an oval-shaped piece of fabric. Optionally, the fabric can be cut, e.g., simultaneously, creating a hole within the center of the oval-shaped piece of fabric. At step 606, a piece of conductive material, comprising, for example, the conductive rubber composition(s) of, for example, Tables 1-2, generally in an oval-shape, i.e., a conductive insert, is joined with the first piece of fabric to form a conductive sole. For example, a heat staking process may be used, such as a hot-bar seal and, optionally, comprise two substantially concentric hot bar seals, to join the first piece of fabric with the oval-shaped conductive material. For example, the heat staking process may be as described above with respect to Table 3. Also, the conductive insert may be joined to the piece of fabric using other processes, e.g., by high-frequency welding, e.g., ultrasonic welding.

The piece of conductive material, which will become the conductive insert, may be cut to any reasonable size at any time, though typically before joining with the piece of fabric at step 604. Exemplary embodiments can comprise a conductive insert that is, for example, approximately 200-250 mm in length and approximately 25-50 mm in width. The size of the conductive insert is generally somewhat smaller than the piece of fabric, so that an outer perimeter of the piece of fabric is not adhered to the piece of conductive material. The perimeter of the fabric material, as discussed further below, is joined with a protective suit.

At step 608, a piece of fabric, generally in the shape of a trapezoid, having a first end and a second end, is joined together at the first end and the second end, by ultrasonic welding and heat-sealing tapes, forming an upper portion in a truncated conical shape and having a large diameter bottom portion and a relatively smaller top portion.

At step 610, the perimeter of the large diameter bottom portion of the upper portion is joined to the conductive sole, as described above, to form a conductive shoe. At step 612, optionally, a perimeter of the smaller top portion of the upper portion is joined to a protective garment, such as the pant leg of a protective suit, using ultrasonic welding and heat sealing tapes. The protective suit may be an encapsulated suit or a non-encapsulated suit, e.g., coveralls.

All ranges recited herein include ranges therebetween, and can be inclusive or exclusive of the endpoints. Optional included ranges are from integer values therebetween (or inclusive of one original endpoint), at the order of magnitude recited or the next smaller order of magnitude. For example, if the lower range value is 0.2, optional included endpoints can be 0.3, 0.4, . . . 1.1, 1.2, and the like, as well as 1, 2, 3 and the like; if the higher range is 8, optional included endpoints can be 7, 6, and the like, as well as 7.9, 7.8, and the like. One-sided boundaries, such as 3 or more, similarly include consistent boundaries (or ranges) starting at integer values at the recited order of magnitude or one lower. For example, 3 or more includes 4 or more, or 3.1 or more.

The foregoing description of embodiments of the disclosure comprises a number of elements, devices, machines, components and/or assemblies that perform various functions as described. These elements, devices, machines, components and/or assemblies are exemplary implementations of means for performing their respectively described functions.

Although only a few exemplary embodiments of the present disclosure have been described in detail above, those skilled in the art will readily appreciate that many modifications are possible in the exemplary embodiments without materially departing from the novel teachings and advantages of this disclosure.

The invention claimed is:

1. A shoe configured to form part of a protective suit providing a protective barrier, the shoe having a conductive sole comprising:

a first fabric configured to provide a protective barrier, having an inner perimeter and an outer perimeter, the inner perimeter defining a hole in the fabric; and a first conductive polymeric material configured to provide a protective barrier, joined with the first fabric to fill the hole, wherein the inner perimeter surrounds a hole-filling portion of the first conductive polymeric material to form the conductive sole and an overlap of the first fabric and the first conductive polymeric material define a first attachment area, a second attachment area, and a middle sealed area disposed between the first attachment area and the second attachment area, the first fabric and first conductive polymeric material joined at the first and second attachment areas and not at the middle sealed area, forming a double bar seal, wherein a conductive pathway from an interior of the shoe to the ground consists of the conductive polymeric material.

2. The shoe of claim 1, further comprising a second fabric joined to the outer perimeter of the first fabric.

3. The shoe of claim 1, wherein the outer perimeter of the first fabric is adapted to be joined to another fabric.

4. The shoe of claim 1, wherein the conductive polymeric material comprises a thermoplastic material having conductive carbon black particles.

5. The shoe of claim 1, wherein the conductive polymeric material comprises a polyolefin material, a polyolefin elastomer, a thermoplastic vulcanizate, and/or a thermoplastic elastomer.

6. The shoe of claim 1, the conductive polymeric material comprising at least one of an ethylene-propylene-diene, natural rubber, synthetic polyisoprene, butyl rubber, nitrile-butadiene, polyurethane, or poly(vinyl chloride) material.

7. The shoe of claim 1, wherein the conductive polymeric material comprises a volume resistance ranging from approximately $10^4$ to $10^8$ ohms.

8. The shoe of claim 1, wherein the conductive polymeric material ranges from about 0.70 to about 1.0 mm in thickness.

9. The shoe of claim 1, wherein the shoe is a conductive joined to a protective garment.

10. The shoe of claim 9, wherein the protective garment is an encapsulating suit.

11. A method for making a conductive shoe, comprising:

cutting a first fabric, forming a toroid-shaped first member defining a hole;

adhering a conductive thermoplastic material to the toroid-shaped first member to fill the hole; thereby forming a conductive sole having a perimeter of the first fabric;

joining a first end and a second end opposite the first end of a second fabric, forming an upper portion; and joining the fabric perimeter of the conductive sole to the upper portion, wherein the conductive shoe configured to form part of a protective suit providing a protective barrier is formed, wherein a conductive pathway from an interior of the conductive shoe to the ground consists of the conductive thermoplastic material.

12. The method of claim 11, wherein the adhering comprises heat staking the toroid-shaped first member to the conductive thermoplastic material.

13. The method of claim 11, wherein the conductive thermoplastic material comprises at least one of a thermoplastic polyolefin, a thermoplastic rubber, and a thermoplastic elastomer, any of which contains conductive particles.

14. The method of claim 11, wherein the second end opposite the first end of the second fabric are joined with heat sealing tapes and ultrasonic welding.

15. The method of claim 11, wherein the second end opposite the first end of the second fabric are first joined via ultrasonic welding followed by sealing with heat sealing tapes, wherein the conductive shoe is joined with a protective suit via heat sealing tapes and ultrasonic welding.

16. A protective suit comprising:

at least one first shoe attachment region; and at least one shoe according to claim 1 joined to the first shoe attachment region.

17. The protective suit of claim 16, wherein the at least one shoe further comprising a second fabric joined to the outer perimeter of the first fabric.

18. The protective suit of claim 16, wherein the outer perimeter of the first fabric is adapted to be joined to another fabric.

19. The protective suit of claim 16, wherein the conductive polymeric material comprises a thermoplastic material having conductive carbon black particles and wherein the conductive polymeric material has a thickness of about 0.70 to about 1.0 mm.

20. The protective suit of claim 16, wherein the conductive polymeric material comprises a volume resistance ranging from approximately $10^4$ to $10^8$ ohms.

* * * * *